US008006531B2

(12) United States Patent
Patuzzi et al.

(10) Patent No.: US 8,006,531 B2
(45) Date of Patent: Aug. 30, 2011

(54) KINEMATIC SYSTEM FOR THE DISPLACEMENT OF WORKING UNITS OF MACHINES FOR BENDING AND FORMING METALLIC SHEETS

(75) Inventors: Luigi Patuzzi, Monteforte d'Alpone (IT); Maurizio Felici, Lonigo (IT); Mikael Norbert Haag, Vantaa (FI)

(73) Assignee: Finn-Power Oy, Kauhava (FI)

( * ) Notice: Subject to any disclaimer, the term of this patent is extended or adjusted under 35 U.S.C. 154(b) by 626 days.

(21) Appl. No.: 11/577,580

(22) PCT Filed: Oct. 22, 2004

(86) PCT No.: PCT/IT2004/000581

§ 371 (c)(1),
(2), (4) Date: Feb. 26, 2008

(87) PCT Pub. No.: WO2006/043292

PCT Pub. Date: Apr. 27, 2006

(65) Prior Publication Data

US 2008/0264135 A1 Oct. 30, 2008

(51) Int. Cl.
*B21D 5/04* (2006.01)

(52) U.S. Cl. ..... 72/306; 72/323; 72/450

(58) Field of Classification Search ..... 72/306, 72/316, 319, 322, 323, 384, 387, 388, 450; 29/243.58

See application file for complete search history.

(56) References Cited

U.S. PATENT DOCUMENTS

| | | | | |
|---|---|---|---|---|
| 4,356,716 | A * | 11/1982 | Aschauer | 72/322 |
| 4,411,148 | A * | 10/1983 | Aschauer et al. | 72/306 |
| 4,843,862 | A * | 7/1989 | Salvagnini | 72/319 |
| 5,934,133 | A * | 8/1999 | Takahashi et al. | 72/306 |
| 6,470,727 | B1 * | 10/2002 | Kunze | 72/323 |
| 7,114,360 | B2 * | 10/2006 | Ikeda | 72/306 |

FOREIGN PATENT DOCUMENTS

WO WO2004/069444 * 8/2004

* cited by examiner

*Primary Examiner* — David Jones
(74) *Attorney, Agent, or Firm* — Greenberg Traurig, LLP

(57) ABSTRACT

A bending machine designed to bend and shape sheet metal comprises a blade-holder unit (10) with a "C" shaped cross-section, mobile along two mutually orthogonal directions with respect to a fixed bed, and on which one or more bending blades are fixed. This machine comprises a kinematic system for driving the operating units, in which servomotors (15, 21, 22) and epicyclical reduction gears are used for the movement of the blade-holder unit (10). Moreover, the blade-holder unit (10) of the bending machine uses an articulated mechanism consisting of two mechanical units (13, 14) which form a closed kinematic chain with five members connected by five kinematic turning pairs.

21 Claims, 8 Drawing Sheets

KINEMATIC SYSTEM FOR THE DISPLACEMENT OF WORKING UNITS OF MACHINES FOR BENDING AND FORMING METALLIC SHEETS

This application is a national stage filing under 35 U.S.C. 371 of International Application PCT/IT2004/000581, filed on Oct. 22, 2004. The entire teachings of the referenced Application is incorporated herein by reference. International Application PCT/IT2004/000581 was published under PCT Article 21(2) in English.

BACKGROUND

1. Field

The present disclosure concerns a kinematic movement system for operating units of avant-garde bending machines. These are automatic machines for bending and shaping sheet metal.

This kinematic system features the electrical actuation and a particular kinematic drive of the main movements responsible for bending. The disclosure differs from machines currently produced which have hydraulic actuation.

The system according to the disclosure can be applied to a compact bending machine. In terms of weight and size such a machine can fit in a container, without the noisy and cumbersome hydraulic control unit. An ecological advantage is that it does not require topping up with great quantities of mineral oil. The machine is faster and more reliable than current machines and has more limited production costs.

This disclosure can be applied in the production of bending machines, and also to industrial bending machines for sheet metal.

2. General Background

It is known that the industry relative to the production of sheet metal items uses bending machines that allow a series of bends to be made in a single piece of sheet metal, in a completely automatic and controlled way, in order to obtain a finished product such as, for example, a cooker hood or a shelf.

It is also known that bending machines for sheet metal normally consist of:

- a fixed bed to support the material, for example sheet metal, to be bent;
- a support frame for a clamping press;
- a punch, being part of the press, and a corresponding counter-punch acting as means for clamping the material during the bending phase;
- one or more bending blades that can be moved towards the material being processed;
- appropriate kinematic motions designed to move the bending blade or blades along the bed for shaping the piece clamped between the punch and the counter-punch;
- means for moving the sheet metal or the profile towards the blades in working conditions;
- transducers or sensors of various types, to control the process, connected to an electronic unit which controls the production process.

A bending machine of the known type described above, marketed by the applicant hereto, comprises a blade-holder structure with a "C" shaped cross-section, movable in two reciprocally orthogonal directions with respect to the fixed bed, on which the bending blade(s) is (are) fixed.

The profile of the bend that can be obtained with a known automatic bending machine is not just the classic fixed angle profile that can be obtained with a manual bending machine.

The simultaneous control of the positioning of the sheet metal and of the pressure exerted on it makes it possible to obtain radial profiles.

The use of traditional blades, particular tools and dies, included in the bending cycle, also makes it possible to form special profiles, without the need for the intervention of an operator when the length or the special tool changes.

SUMMARY

The blades are supported by a load-bearing C-shaped structure mounted on the main frame. The unit comprises two blades: the upper one for negative bends (downwards) and the lower one for positive bends (upwards).

The system controls the dimensions of the angles and the thickness of the sheet metal, adjusting the position of the blades by means of proportional valves. All the movements are carried out by proportional control hydraulic cylinders. A special mechanism guarantees the parallelism of the movements of the bending unit.

The presser tool is mounted on an electrowelded structure with four arms, hinged at the rear of the main frame.

The movements of the C-shaped structure and of the tools are controlled by hydraulic cylinders. The cylinders can be programmed by means of the control unit in order to achieve the highest degree of precision during all the bending phases.

Traditional hydraulic bending machines, like other bending machines present on the market, are fitted with a kinematic structure which determines and controls the movement of the blade-holder unit.

This structure can in some cases be the pentalateral type, that is consisting of a closed kinematic chain with five members connected by five kinematic pairs.

The traditional pentalateral type kinematic chain is used in order to provide the machine with torsional rigidity and not therefore with specific mechanical functions. In addition, the pentalateral type is not actuated by frame cranks.

DRAWINGS

The above-mentioned features and objects of the present disclosure will become more apparent with reference to the following description taken in conjunction with the accompanying drawings wherein like reference numerals denote like elements and in which.

Figure 10:
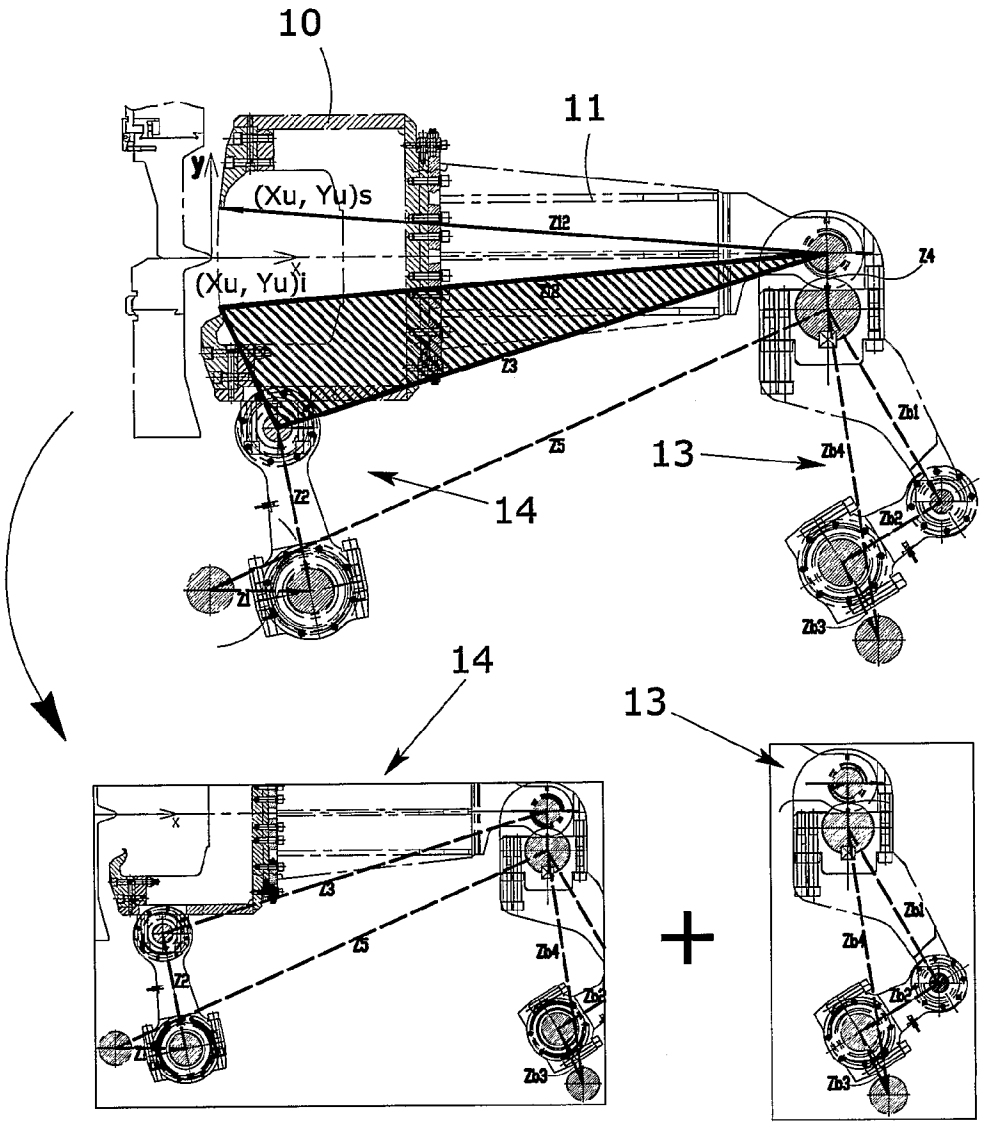
Figure 11:
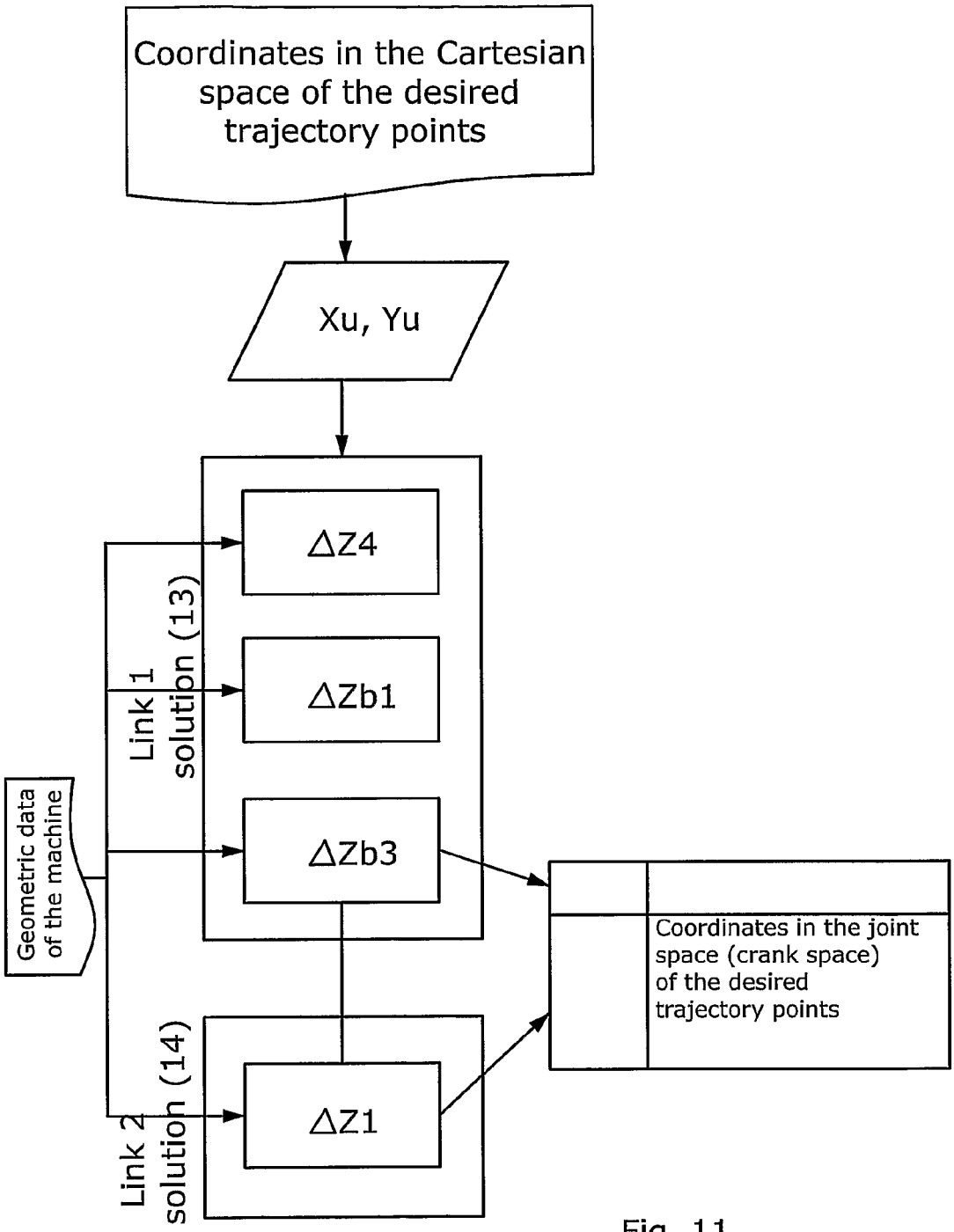

FIGS. 10 and 11 respectively show, in the form of a schematic illustration and a block diagram, the calculation procedure of the inverse kinematic system in analytical form for the bending machine according to the disclosure.

DETAILED DESCRIPTION

Figure 1:
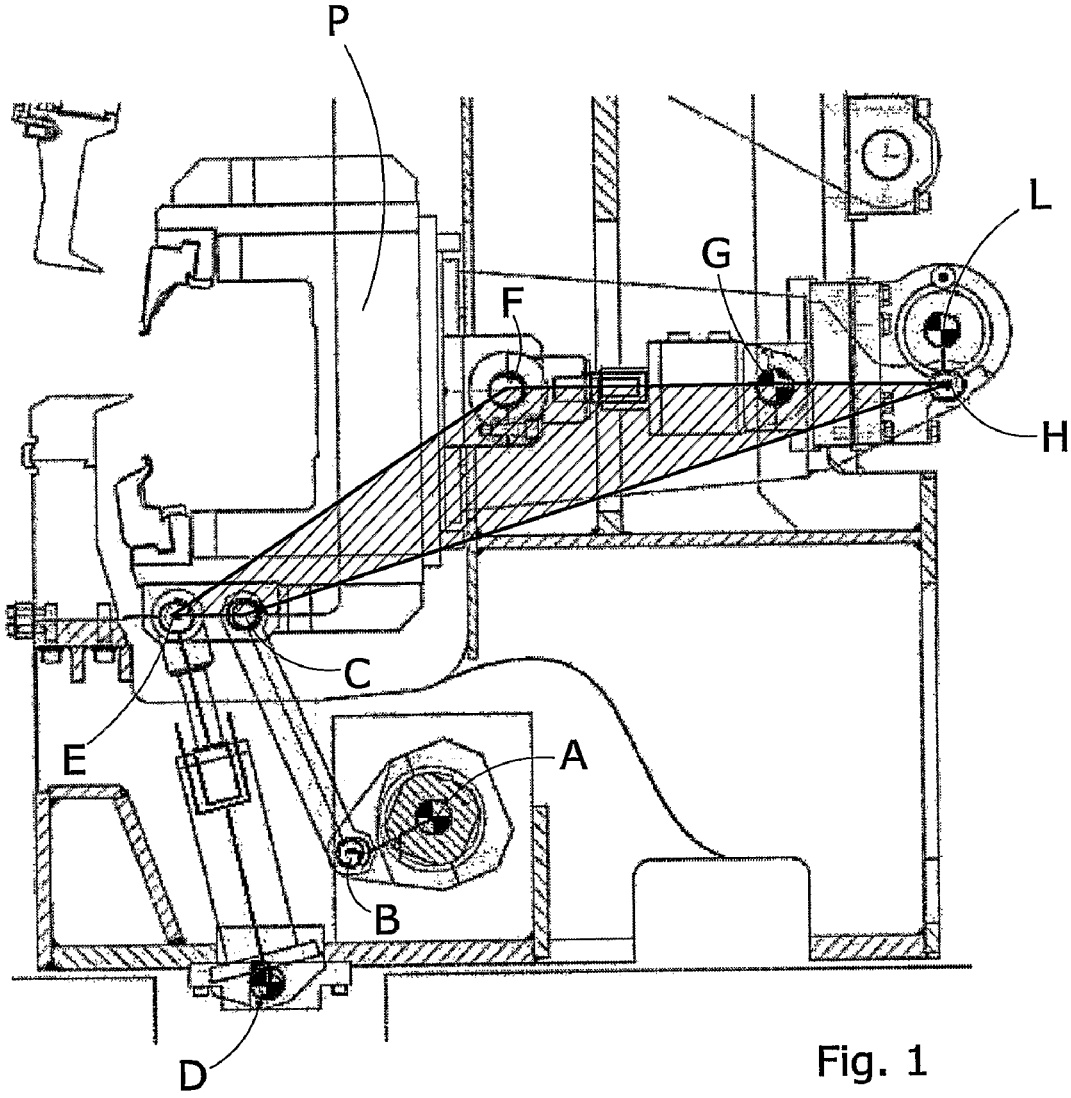
FIG. 1 represents a schematic side view of a traditional type bending machine.

FIG. 1 shows the kinematic diagram of a traditional system for the movement of the blade-holder unit P.

With reference to FIG. 1, the letters A, D, L and G indicate the frame fixed torque points around which the members rotate, while the letters B, C, E, F and H indicate the turning couplings that allow a degree of rotation freedom in the relative movement of the members.

In such machines, the pentalateral is not actuated by means of frame cranks but by hydraulic cylinders. This does not present any singularity combination.

This is a mechanism which presents certain structural and functional limitations, such as:

- the machine is very noisy since the entire kinematic system is driven by hydraulic type circuits and components;
- it uses considerable amounts of oil to activate a very complex hydraulic circuit;
- it uses considerable amounts of electricity for the functioning of the entire complex hydraulic system;
- the environmental impact of the machine is therefore extremely negative as regards noise and the consumption of oil and electricity.

Specific analyses carried out on traditional bending machines have also shown that the usual mechanism for bending the sheet metal cannot be controlled electrically since the sensitivity coefficients of the tool with respect to the frame cranks are too high.

These high sensitivity coefficients of traditional bending machines are unable to provide the necessary amplification to the torque provided by the reduction motors (brushless motor+epicyclical reduction gear) available on the market. The only type of drive for known kinematic systems is therefore hydraulic.

Other types of motors cannot be used due to the movement laws to be carried out. Other reduction units (ordinary gear trains) are not compatible with the weights and dimensions of the machines.

Another problem is the non-absolute precision of the machine. This is due to the two synchronized movements that make it possible to define the trajectory of the tool are achieved by two groups of hydraulic cylinders which by virtue of their position are not completely independently for the horizontal and vertical movement of the tool.

The hydraulic cylinders responsible for the horizontal movement of the blade-holder unit also produce an unwanted vertical movement. In the same way the vertical cylinders also produce a horizontal movement.

This is due to the positioning of the cylinders which are not at right angles to each other, and also do not form fixed angles with respect to the frame.

This disclosure provides a kinematic system to drive operating units of bending machines. The system is able to eliminate or at least reduce the disadvantages described above.

The disclosure provides a kinematic system to drive operating units of a new concept of bending machines. Servomotors and epicyclical reduction gears are used for the movement of the blade-holder unit instead of the traditional hydraulic actuators.

The servomotors and reduction units make it possible to achieve higher performance levels than those of a hydraulic system. This also ensures a constant delivered torque that cannot be obtained with a hydraulic system that uses accumulators and thus necessarily has a pressure that slowly decreases during bending.

Electric servomotors, by virtue of the intrinsic linearity of their model of behavior, allow the use of advanced control patterns to carry out freely defined trajectories and interpolations, with practically no errors in position and speed. Such levels of performance cannot be achieved with a hydraulic system controlled by means of proportional valves because of the non-linearity caused by the fluid and of the more reduced pass-band of this drive.

These advantages are achieved by a kinematic system for driving the operating units of a bending machine. These features are described in the main claim.

The dependent claims describe advantageous embodiments of the disclosure.

A main advantage of this solution is that the blade-holder unit of the bending machine uses an articulated mechanism. By definition, this is a variable speed mechanism.

This means that, with the same drive speed, very low speeds can be used in the few seconds immediately prior to closing/opening. Decidedly higher speeds can be used during the rest of the presser stroke.

This also allows a further reduction in cycle time and a consequent increase in machine performance.

The machine is actuated electrically, by an appropriate electronic control unit. This employs an original mechanism for the movement of the bending blades. This can produce an amplification of the torque sufficient to generate the force on the tools necessary to bend the thicknesses and lengths as per the machine specifications.

The articulated system that constitutes the mechanism is a kinematic plane mechanism. This is a mechanism in which the members move with plane motion, with the axes of the turning pairs parallel to each other and at right angles to the plane of motion.

From the topological point of view (number of members and type of couplings) this is a closed kinematic chain with five members connected by five kinematic turning pairs.

One of these members is the frame of the machine. This kinematic chain has two actual degrees of freedom. This allows two independent motors. The two frame cranks were chosen as motor elements.

From the geometric point of view, the mechanism:

- has the necessary working space for the correct movement of the bending blades in the fields foreseen by the application;
- presents particular geometric configurations (corresponding to conditions of kinematic singularity in the case of kinematic inversion of motion) in a neighbourhood of the configurations in which the mechanism bends the sheet metal, sufficient to generate the necessary amplification of the torques. There are two of these configurations, corresponding to the so-called positive bend and negative bend.

The mechanism according to this disclosure is such as to be in a condition of dual kinematic singularity (referring to inverse motion) in a neighbourhood of both the above-mentioned configurations.

This dual singularity is achieved by simultaneously aligning the first motor crank with the first connecting rod and the second motor crank with the second connecting rod.

This concept is independent of the geometric dimensions of the members or of the position of the frame kinematic pairs. The amplification effect depends to some extent on these dimensions, and on the working space of the machine.

The blades of the machine according to the disclosure are moved by an articulated system with two degrees of freedom that presents evident kinematic non-linearity, the movement of the bending blades. This is characterized by well-defined bending trajectories, and is made possible and programmable by a special original inverse kinematic algorithm of the non-iterative type. This is inserted in the numerical control or used as a pre-processor. This makes it possible to carry out well-defined trajectories with interpolated axes such as, for example, the classic circular interpolation.

In particular, a method and an algorithm typical of the field of robotics were applied to a machine tool, in an appropriately adapted way. This allows movement control by variables other than the tool coordinates, not orthogonal but independent of each other.

This algorithm defines the law of motion, exactly and without approximation. This corresponds to a desired tool trajectory, unlike what occurs in hydraulic bending machines in which the trajectory is traditionally set in the actuator space, which differs from the Cartesian space, and is therefore approximated regardless of the controller quality.

This algorithm resolves the position kinematics in a non-iterative way and thus with zero error.

According to the disclosure, the inverse kinematic algorithm comprises the subsequent solution of two closed links, each of which corresponds to two non-linear closing equations in two unknown quantities.

The non-iterative solution takes place by geometric type considerations.

This inverse kinematic algorithm, combined with the high precision of the controller that works on electric axes, makes it possible to carry out particular trajectories, other than the circular one, with particular features and uses.

In particular the machine according to the disclosure foresees the use of a new and original bending trajectory. This is unlike the known solutions, which allows the bending blade to turn on the sheet metal without sliding.

This trajectory is particularly useful in processing materials with a protective film as it prevents the film from being torn and the consequent damage to the sheet metal.

In this case, the blade and the sheet metal behave like two conjugate profiles and the resulting trajectory is a sort of circle involute. It can be observed that by mathematically imposing the non-slipping constraint between the blade and the sheet metal, a bond is achieved between the two free (or generalised) coordinates which define the trajectory.

The quality of the semifinished part processed by the machine according to the disclosure is excellent. This is achieved by a considerably quieter machine compared to previous machines and uses reduced quantities of oil for a much simpler hydraulic circuit.

The environmental impact of the new machine is completely different with respect to the solutions known, since it is less noisy and uses considerably less oil.

FIG. 1 shows the described drive method of the blade-holder unit P moved by a hydraulic drive system using actuators. Points A, D, L and G refer to the fixed frame torque points, around which the members turn. B, C, E, F, and H indicate the turning couplings that allow a rotational degree of freedom to the relative motion of the members. This system presents all the problems mentioned above, which the disclosure resolves.

Figure 2:
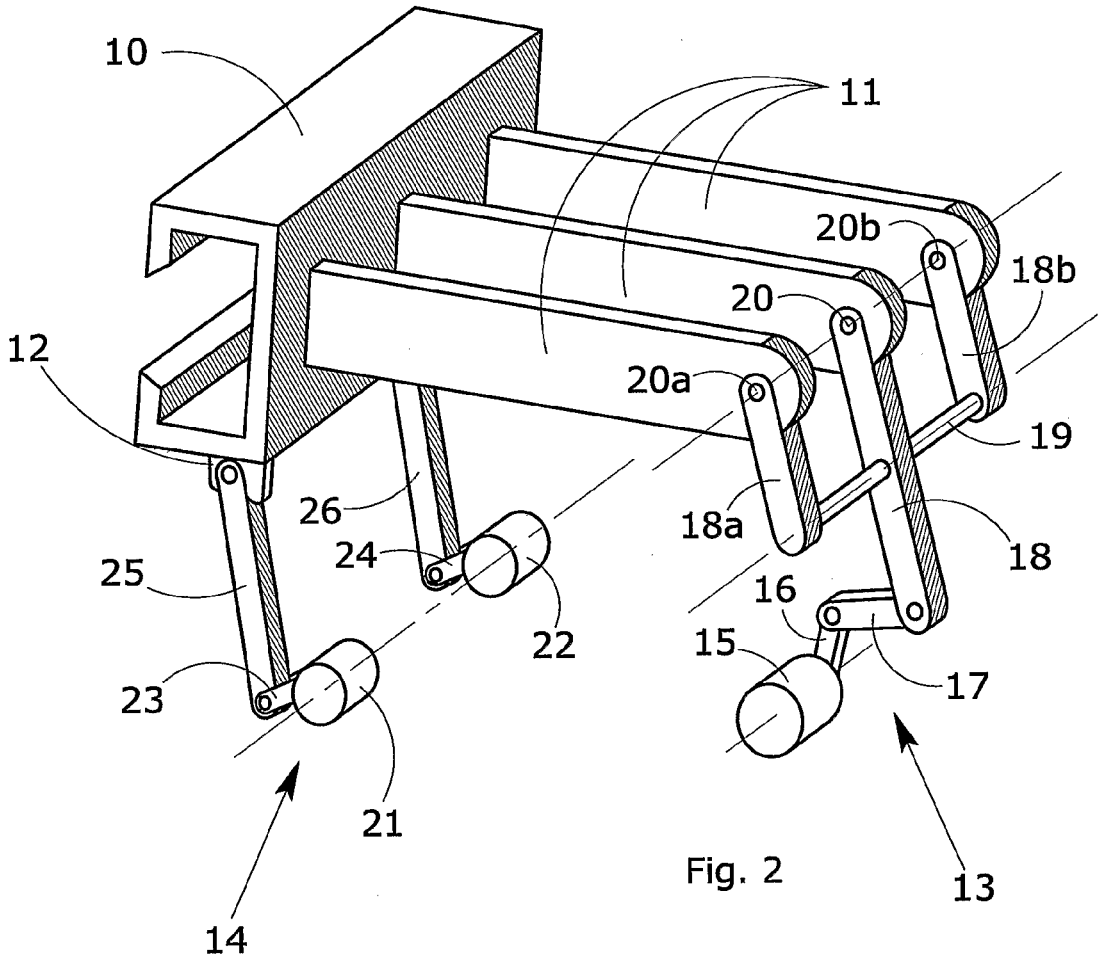
FIG. 2 represents the three-dimensional schematic view of a general model of the kinematic system according to the disclosure which drives the blade-holder unit of a bending machine.

In FIG. 2, the bending machine according to the disclosure is equipped with a blade-holder unit 10, which uses servomotors and epicyclical reduction gears instead of traditional hydraulic actuators to control its movements.

From the structural point of view, the rear part of the blade-holder unit is integral with a plurality of supports 11, while plinths 12 are fixed on its lower part. The supports 11 and the plinths 12 are involved in the action of a particular kinematic system. The chain has two degrees of freedom, depending on two mechanical units indicated, respectively, by 13 and 14.

The articulated system which makes up the mechanism is kinematically considered a plane mechanism. This is a mechanism in which the members move with plane motion. The axes of the turning pairs are parallel to each other and at right angles to the plane of motion.

From the topological point of view, the number of members and the type of couplings, is a closed kinematic chain with five members connected by five kinematic turning pairs.

One of these members is the frame of the machine. This kinematic chain has two degrees of freedom. This allows two independent motors, each installed on the respective mechanical unit.

The first independent servomotor 15 is part of the first mechanical unit 13, to which a crank 16 is fitted, attached in turn to a connecting rod 17, with its other end hinged to a lever 18.

This lever 18 is equipped with a pivot on the shaft 19, while its other end, the one opposite to the coupling point with the connecting rod 17. These branch into a series of elements 18*a* and 18*b*, which are coupled to the same number of pins 20*a* and 20*b* positioned on the ends of the supports 11 integral with the blade-holder unit 10.

The second mechanical unit 14 consists of two servomotors 21 and 22 which drive respective cranks 23 and 24 hinged in turn to respective connecting rods 25 and 26. The other ends are attached to the plinth 12 of the blade-holder unit 10.

All the cranks can be constructively represented by eccentric elements having the same function and that the two frame cranks were chosen as motor elements.

From the geometric point of view, the mechanism:

- has the necessary working space for the correct movement of the bending blades in the fields foreseen by the application;
- presents particular geometric configurations (corresponding to conditions of kinematic singularity in the case of kinematic inversion of motion) in a neighborhood of the configurations in which the mechanism bends the sheet metal, sufficient to generate the necessary amplification of the torques. There are two of these configurations, corresponding to the so-called "positive bend" and "negative bend".

This mechanism is in a condition of dual kinematic singularity (referring to inverse motion) in a neighborhood of both the above-mentioned configurations.

This dual singularity is achieved by simultaneously aligning the first motor crank 23, 24 with the first connecting rod 25, 26 and the second motor crank 16 with the second connecting rod 17.

Figure 3:
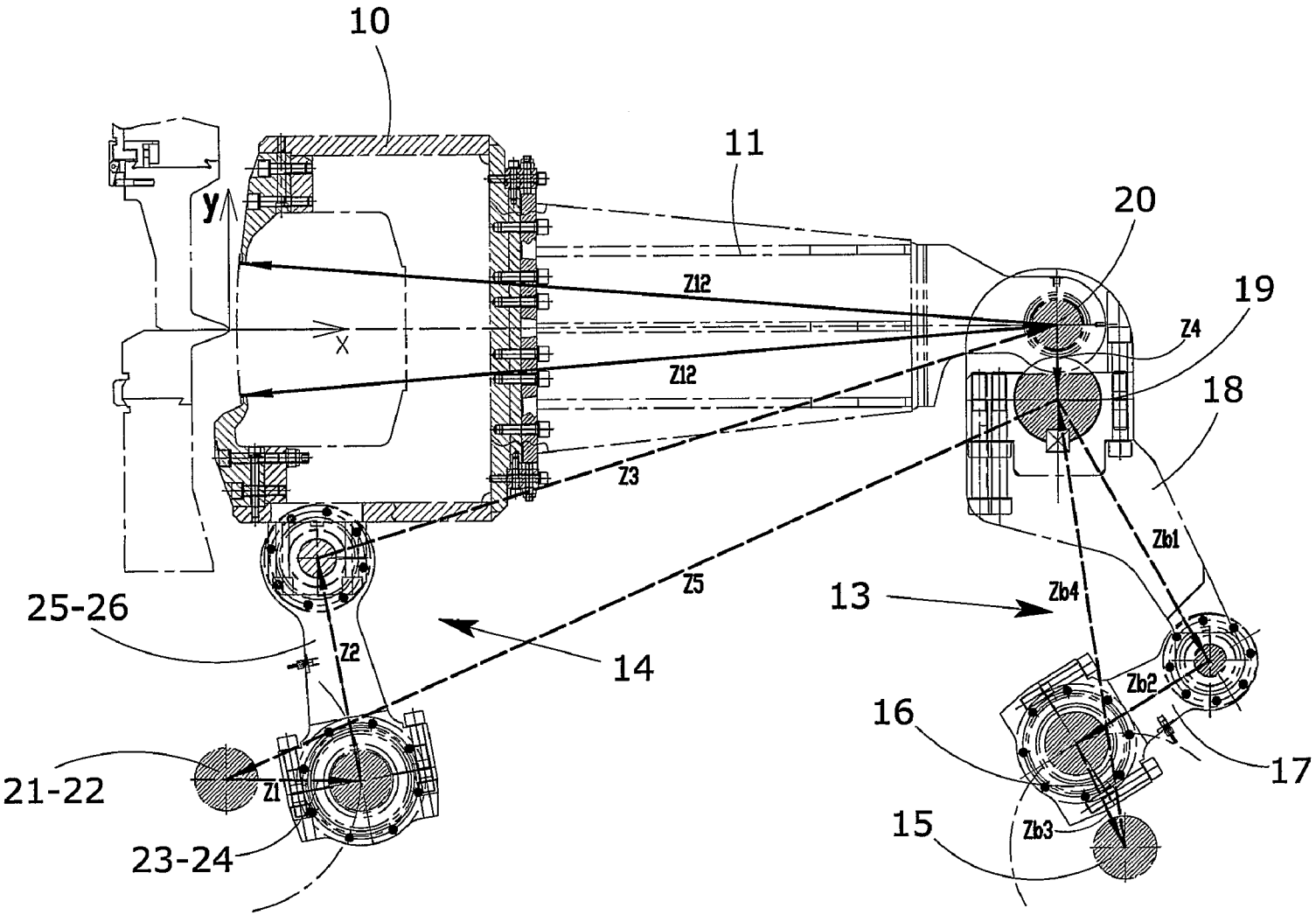
FIG. 3 is a schematic view of the same kinematic model represented on the flat, showing the trajectory lines of the links.

FIG. 3 shows the trajectories of the links and in particular, the Z references indicate the following kinematic connections:

Z1—crank 23, 24 of the first link between the motor 21, 22 and the connecting rod 25, 26;

Z2—trajectory of the connecting rod 25, 26 of the first link;

Z3—trajectory of the first link between the hinge of the connecting rod 25, 26 and the blade-holder unit 10, and the hinge 20 of the lever 18;

Z4—trajectory of the first link between the hinge 20 of the lever 18 and the pivot 19 of this lever;

ZB1—trajectory of the second link between the pivot 19 of the lever 18 and the hinge between the crank 18 and the connecting rod 17;

ZB2—trajectory of the second link between the hinge of the crank 18 and connecting rod 17 and the hinge of the connecting rod 17 and the crank 16;

ZB3—trajectory of the second link between the hinge of the connecting rod 17 and the crank 16, and the shaft axis of the motor 15.

Figure 4:
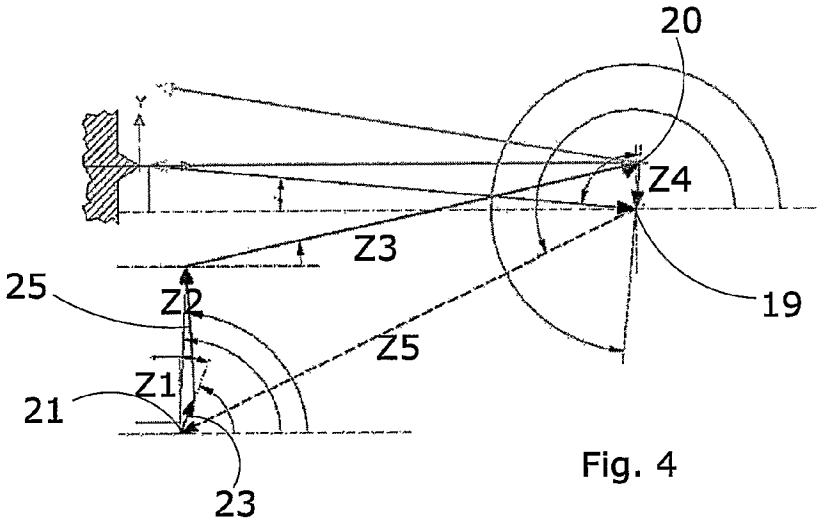
Figure 5:
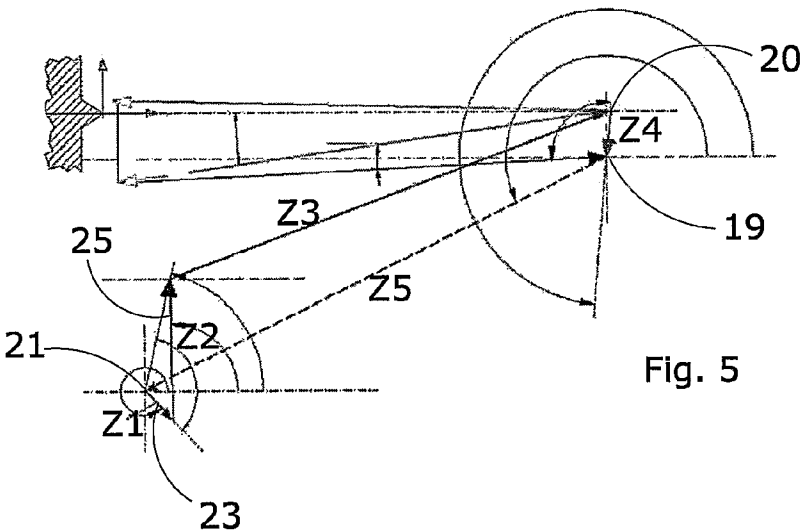

FIGS. 4 and 5 show the positions of the members, which are represented by vectors. These give rise to the dual singularity of the mechanism in the neighborhood of the bending configurations.

FIG. 4 shows a first singular configuration with the start of a positive bend.

FIG. 5 shows a first singular configuration with the start of a negative bend.

Figure 6:
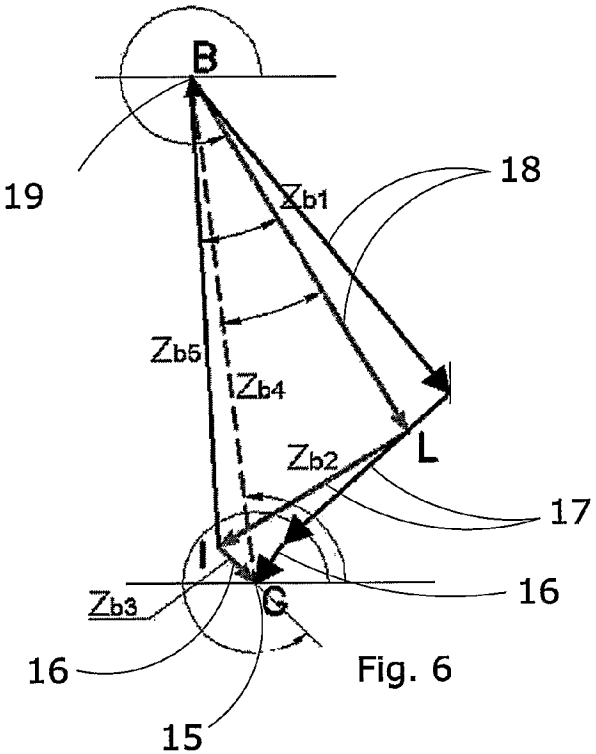
FIGS. 4 to 6 show views of kinematic models of the blade-holder drive unit.

FIG. 6 shows the second singular configuration of the crank 16 and the connecting rod 17: fine dashed line start of the positive or negative bend and long dashed line end of the bend.

It should also be pointed out that the disclosed concept is independent of the geometric dimensions of the members or of the position of the frame kinematic pairs. It is evident that the amplification effect depends to some extent on these dimensions, and on the working space of the machine.

The blades of the machine according to the disclosure are moved by an articulated system with two degrees of freedom that presents evident kinematic non-linearity. The movement of the bending blades is characterized by well-defined bending trajectories. This is made possible and programmable by a special original inverse kinematic algorithm of the non-iterative type which, inserted in the numerical control or used as a pre-processor. This makes it possible to carry out well-defined trajectories with interpolated axes such as, for example, the classic circular interpolation.

Figure 8:
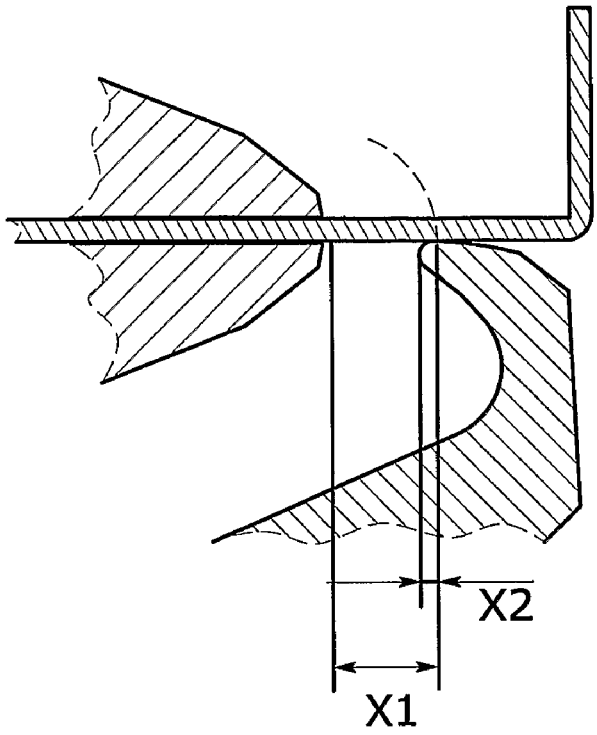
FIGS. 8 and 9 show schematic views of the trajectory of the blade on the sheet metal to be bent, in a first and second operating phase.
Figure 9:
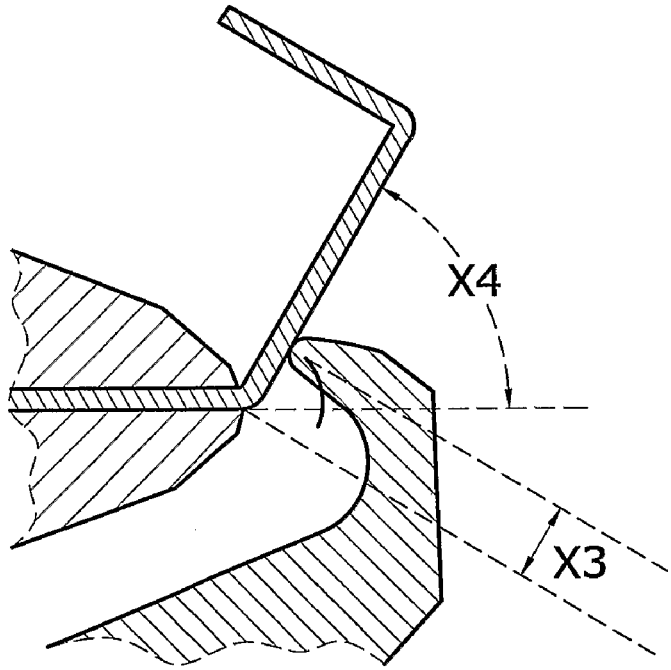

In FIGS. 8 and 9, the particular new bending trajectory is shown which allows the bending blade to turn on the sheet metal without sliding. This trajectory is particularly useful in processing materials with a protective film as it prevents the film from being torn and the consequent damage to the sheet metal.

The reference X1 in FIG. 8 indicates the initial gap between the ends of the sheet metal to be bent and the support, while X2 indicates the radius of the blade.

In FIG. 9, X3 indicates the gap and X4 the bending angle.

The blade and the sheet metal behave like two conjugate profiles and the resulting trajectory is a sort of circle involute. By mathematically imposing the non-slipping constraint between the blade and the sheet metal, a bond is achieved between the two free coordinates which in fact define the trajectory.

The kinematic motion described leads to numerous advantages. The servomotors and the reduction units make it possible to achieve definitely higher levels of performance than those of a hydraulic system and also ensure constant delivered torque. This cannot be achieved with a hydraulic system that uses accumulators and thus necessarily has a pressure that slowly decreases during bending.

In addition, the quality of the semifinished part processed by the machine according to the disclosure is excellent and is achieved by means of a considerably quieter machine compared to previous machines and uses reduced quantities of oil for a much simpler hydraulic circuit.

The environmental impact of the new machine is completely different with respect to the known solutions, since it is less noisy and uses considerably less oil.

Figure 7:
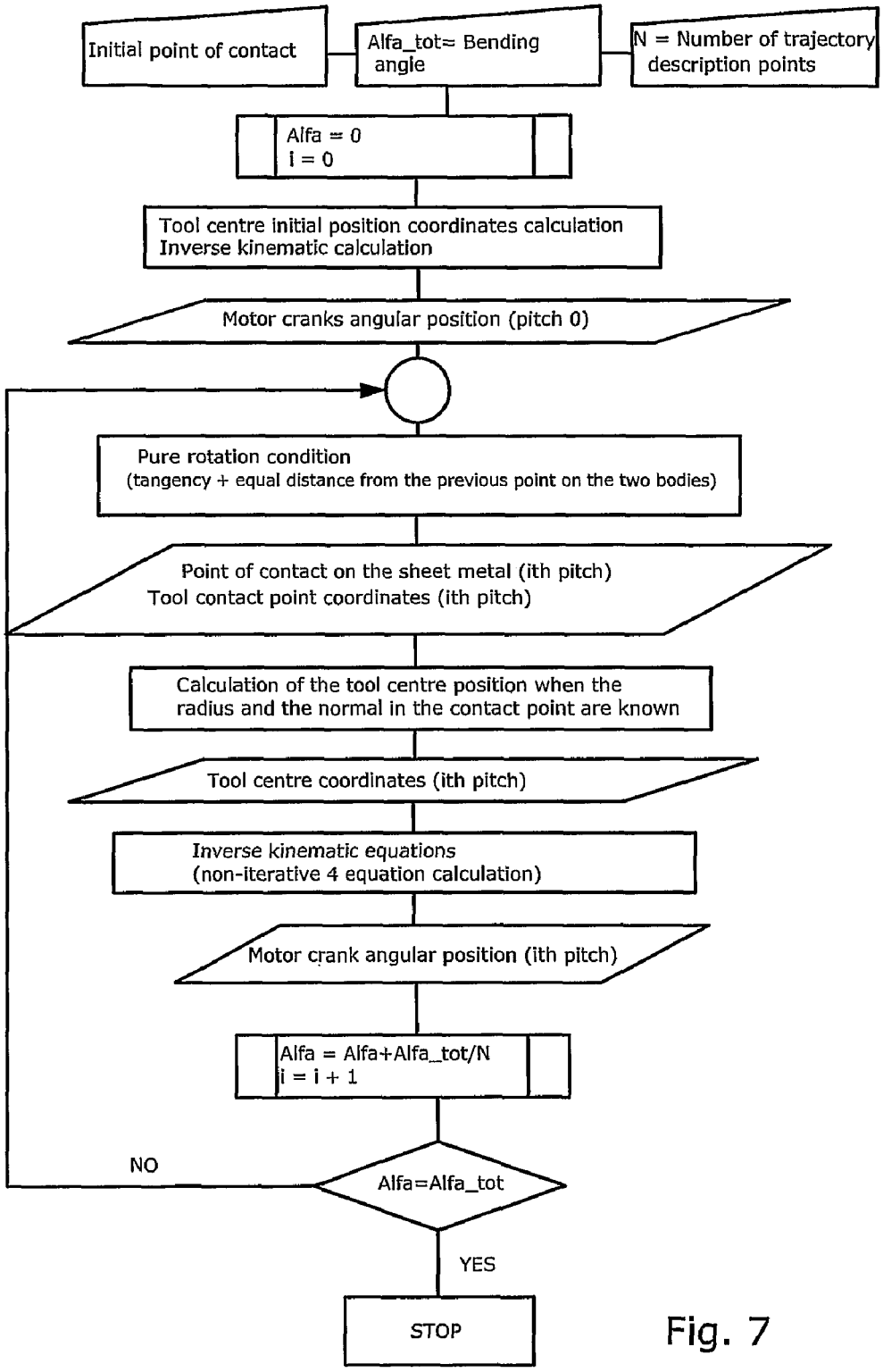
FIG. 7 is a block diagram of the bending trajectory generation system in the machine according to the disclosure.

FIG. 7 is a block diagram relative to the control program of the bending machine. This block diagram makes it possible to define the mathematical calculus approach used to set a condition of turning and not of sliding of the blade on the sheet metal to be bent.

The disclosure is described above with reference to a preferred embodiment. It is nevertheless clear that the disclosure is susceptible to numerous variations within the framework of technical equivalents.

The invention claimed is:

1. A kinematic system for driving operating units of a bending machine designed to bend and shape sheet metal, said machine comprising a blade-holder unit with a "C" shaped cross-section, moveable along two mutually orthogonal directions with respect to a fixed bed, the unit being equipped with a bending blade and including an articulated mechanism including two mechanical units, and wherein the first mechanical unit includes:

a servomotor, a drive crank having two ends, a connecting rod having two ends, a support having a first end and a second end, a first end of the crank being connected with the motor whereby rotation of the motor effects movement of the drive crank, a second end of the drive crank being connected to a first end of the connecting rod whereby movement of the drive crank creates movement of the connecting rod, a second end of the connecting rod being pivotally connected with the first end of the support, and the second end of the support being connected to the blade-holder unit such that movement of the connecting rod effects movement of the blade-holder unit; and the second mechanical unit includes:

two servomotors and epicyclical reduction gears, the two servo motors being located spaced apart from each other, two drive cranks each having two ends, two connecting rods each having two ends, a first end of each respective crank being connected with a respective motor whereby rotation of the motor effects movement of the drive crank, a second end of each respective drive crank being connected to a first end of the respective connecting rod whereby movement of the respective drive crank creates movement of the respective connecting rod, a second end of each respective connecting rod being connected with the blade-holder unit such that movement of the respective connecting rods effects movement of the blade-holder unit.

2. The kinematic system according to claim 1 including a lever system in the first mechanical unit, the lever system including two ends and being structurally part of the pivotal connection, and being such that the one end is hingedly connected to the connecting rod and the second end is hingedly connected to the support.

3. The kinematic system according to claim 2 wherein the lever system includes three lever units, each lever unit being spaced from the other and being substantially parallel with each other and each lever having a first end and a second end, such that there is central lever and a lever to either side of the central lever, the central lever being for connection to the connecting rod, and a transverse shaft extending between the three levers, the two side levers being connected at a first end to the transverse shaft, and the support including three support units, each support unit being spaced from the other and being substantially parallel with each other and each support unit having a first end and a second end, and being such that a respective lever is connected with a respective end of each support and the second end of the support is connected with the blade-holder unit.

4. The kinematic system according to claim 1 wherein the first mechanical unit connects with the blade-holder unit in a first plane and the second mechanical unit connects with the blade-holder unit in a second plane.

5. The kinematic system according to claim 4 wherein the "c" shaped blade includes a back face and two respective transverse faces extending from the back face, and the first plane is the back face and the second plane is a transverse face.

6. The kinematic system according to claim 1 wherein the support is rigidly connected to the blade-holder unit, and connecting rod of the second mechanical unit is hingedly connected to the blade-holder unit.

7. The kinematic system according to claim 4 wherein the support is rigidly connected to the blade-holder unit, and connecting rods of the second mechanical unit are hingedly connected to the blade-holder unit.

8. The kinematic system according to claim 3 wherein the first mechanical system provides three connections to the blade-holder unit and the second mechanical unit provides two connections to the blade-holder unit thereby having five members operatively and structurally connected to provide five kinematic turning elements.

9. The kinematic system according to claim 1 wherein there are two configurations of the articulated mechanism, corresponding to positive and negative bends.

10. The kinematic system according to claim 1 further comprising a central electronic control unit for the respective movements of the mechanical units, the control unit implementing an inverse kinematic algorithm for allowing the tool to turn on the sheet metal without sliding on the sheet metal.

11. The kinematic system according to claim 1 further comprising a central electronic control unit for the respective movements of the mechanical units, the control unit implementing inverse kinematic algorithms for defining the trajectories of the tools.

12. The kinematic system according to claim 11 wherein the inverse kinematic algorithms are non-iterative.

13. A bending machine for bending and shaping sheet metal and employing the kinetic system of claim 1 wherein the two mutually orthogonal directions are relative to the bending blade.

14. A bending machine for bending and shaping sheet metal and employing the kinetic system of claim 2 wherein the two mutually orthogonal directions are relative to the bending blade.

15. A bending machine for bending and shaping sheet metal and employing the kinetic system of claim 3 wherein the two mutually orthogonal directions are relative to the bending blade.

16. A bending machine for bending and shaping sheet metal and employing the kinetic system of claim 4 wherein the two mutually orthogonal directions are relative to the bending blade.

17. A bending machine for bending and shaping sheet metal and employing the kinetic system of claim 5 wherein the two mutually orthogonal directions are relative to the bending blade.

18. A bending machine for bending and shaping sheet metal and employing the kinetic system of claim 6 wherein the two mutually orthogonal directions are relative to the bending blade.

19. A bending machine for bending and shaping sheet metal and employing the kinetic system of claim 7 wherein the two mutually orthogonal directions are relative to the bending blade.

20. A bending machine for bending and shaping sheet metal and employing the kinetic system of claim 8 wherein the two mutually orthogonal directions are relative to the bending blade.

21. A bending machine to bend and shape sheet metal comprising a blade-holder unit with a "C" shaped cross-section moveable along two mutually orthogonal directions with respect to a fixed bed, and wherein a bending blade is operatively, structurally, connected and fixed thereto, and including a kinematic system for driving the operating units according to claim 1.

* * * * *